US005634511A

United States Patent [19]

Steen et al.

[11] Patent Number: 5,634,511

[45] Date of Patent: Jun. 3, 1997

[54] SEMI-CONTINUOUS CASTING EQUIPMENT HAVING A CENTERING DEVICE FOR CENTERING A BOTTOM BLOCK RELATIVE TO A CASTING MOLD

[75] Inventors: Idar Steen; Harald Næss, Jr., both of Sunndalsøra, Norway

[73] Assignee: Norsk Hydro a.s., Oslo, Norway

[21] Appl. No.: 454,249

[22] PCT Filed: Sep. 12, 1994

[86] PCT No.: PCT/NO94/00150

§ 371 Date: Aug. 10, 1995

§ 102(e) Date: Aug. 10, 1995

[87] PCT Pub. No.: WO95/10376

PCT Pub. Date: Apr. 20, 1995

[30] Foreign Application Priority Data

Oct. 13, 1993 [NO] Norway ..... 933684

[51] Int. Cl.[6] ..... B22D 11/08

[52] U.S. Cl. ..... 764/425; 164/445

[58] Field of Search ..... 164/483, 425, 164/426, 445, 446

[56] References Cited

U.S. PATENT DOCUMENTS

| | | | |
|---|---|---|---|
| 3,384,152 | 5/1968 | Olsen et al. . | |
| 3,702,631 | 11/1972 | Sergerie | 164/425 |
| 3,847,206 | 11/1974 | Foye | 164/425 |
| 3,877,508 | 4/1975 | Bryson . | |
| 3,957,105 | 5/1976 | Foye . | |

FOREIGN PATENT DOCUMENTS

| | | | |
|---|---|---|---|
| 978719 | 12/1975 | Canada | 164/426 |
| 3291148 | 12/1991 | Japan | 164/445 |
| 1459634 | 12/1976 | United Kingdom . | |

*Primary Examiner*—J. Reed Batten, Jr.
*Attorney, Agent, or Firm*—Wenderoth, Lind & Ponack

[57] ABSTRACT

The apparatus includes an upper metal reservoir (10), a casting mold (2) having an inlet and an outlet, and a vertically moveable base (7) positioned at the outlet with a casting shoe or bottom block (5) which is designed to bear against the outlet at the start of a casting cycle. The casting shoe is mounted as a moveable shoe on the base (7) and is designed to be locked by the direct engagement with the base when it has been brought into a centered position in relation to the casting mold (2). Furthermore, centering devices (3, 4, 8) for the casting mold and the casting shoe are provided thereon for centering the casting shoe in relation to the casting mold.

10 Claims, 1 Drawing Sheet

SEMI-CONTINUOUS CASTING EQUIPMENT HAVING A CENTERING DEVICE FOR CENTERING A BOTTOM BLOCK RELATIVE TO A CASTING MOLD

BACKGROUND OF THE INVENTION

The present invention concerns direct chill, semi-continuous casting equipment for the manufacture of metal ingots. The metal used is primarily aluminum. The casting equipment includes an upper metal reservoir, a casting mold with an inlet and an outlet, and a moveable base positioned below the outlet with a casting shoe or bottom block which is designed to bear against the outlet at the start of a casting cycle.

In connection with the manufacture of metal castings of small dimensions, for example ingots for extrusion purposes, self-centering casting shoes are used. The arrangement is based on a simple principle in which the casting shoes rest on well-greased bases. The casting dies are fitted with a guide edge which guides each of the casting shoes into place in the dies as the moveable base is moved up. This system functions satisfactorily because of the small dimensions and low weight of the casting shoes.

In connection with roll-ingot casting, however, a similar system will not function satisfactorily because the casting shoe (just one) for this type of casting equipment has a considerably larger bearing surface and is considerably heavier.

In connection with roll-ingot casting it is common to use manual centering of the casting shoe by means of a bar. This results in damage to both the casting shoe and the casting mold as a consequence of the bar, and because the edge of the shoe touches the mold wall. The damage in the form of scratches and cuts on the die wall and casting shoe, respectively can result in surface defects in the roll-ingot workpieces and, in the worst case, in leakage between the casting mold and the casting shoe resulting in damaged workpieces.

Recently, a solution has been introduced in which the casting shoe is stationary, and the casting die or mold is centered around the shoe. The casting mold is thus mounted as a moveable mold and is designed to be moved by means of eight pneumatic cylinders fitted at each of the corners of the mold. As the pneumatic cylinders are operated manually, this solution involves the risk of the edge of the casting shoe damaging the casting mold. In addition, such a solution employing a moveable casting mold and a large number of pneumatic cylinders is very expensive in terms of construction and maintenance.

SUMMARY OF THE INVENTION

With the present invention, a solution to the above problems with direct chill casting equipment has been developed and provides safe and accurate centering of a casting shoe or bottom block in relation to the casting mold, thus eliminating damage to these parts. Furthermore, the present invention can be manufactured at a reasonable price and is simple and inexpensive to maintain.

In accordance with the present invention the casting equipment is characterized in that the casting shoe is mounted as a moveable shoe on the base and is designed so that it can be locked in relation to the base when it has been placed in the centered position in relation to the casting mold.

For centering the casting shoe in relation to the casting mold, corresponding centering devices are provided for the casting mold and the casting shoe respectively.

In relation to a preferred embodiment, the support between the base and the casting shoe can include one or more air cushions. The base and the shoe are interlocked by shutting off the air supply to the air cushions so that the casting shoe is lowered down and rests directly on the base after the casting shoe has been brought into the correct position in relation to the casting mold.

In accordance with another aspect of the preferred embodiment, the centering devices include at least two tapered guide pins which correspond to two guide sleeves connected to the casting mold or vice versa.

BRIEF DESCRIPTION OF THE INVENTION

The invention will now be described in further detail by means of examples and with reference to drawings in which:

FIG. 1 is a schematic illustration of casting equipment for the manufacture of roll ingots in accordance with the present invention; and FIGS. 2–4 are similar to FIG. 1 but show the casting shoe for the equipment in different positions.

DETAILED DESCRIPTION OF THE INVENTION

Figure 1:
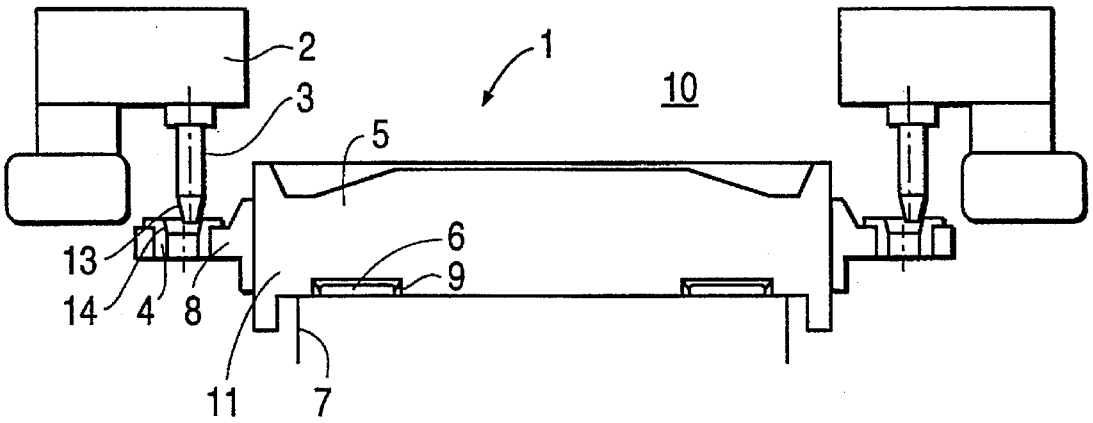

Direct chill, semi-continuous casting equipment 1 for the manufacture of roll ingots, so-called DC (direct chill) casting equipment includes generally, as shown in FIG. 1, an upper metal reservoir 10 which is encased by a casting mold 2, and a vertically moveable base 7 with a casting shoe or bottom block 5 which is designed to bear against the outlet of the casting die at the start of a casting operation.

Devices for water chilling of the metal during the casting operation, possibly devices for the supply of gas or lubricant to the casting mold, and devices for vertical movement of the base are not shown in the drawing as they do not form part of the invention and are unnecessary for an understanding of it.

As mentioned, the casting shoe or bottom block 5 bears against the casting mold outlet and forms the base of the outlet at the start of a casting operation. Liquid metal is supplied to the reservoir 10 from above, and as soon as the metal beings to harden at the casting shoe 5, the shoe is lowered downwardly together with the base 7. At the same time water is supplied through a slot (not shown) which chills the metal further so that a long metal workpiece is formed with a cross-section which is defined by the opening in the casting mold 2. When the base 7 has reached its lowermost position, the casting operation stops, the cast metal workpiece is removed, and the base 7 with the casting shoe 5 is moved back to its original position for commencement of a new casting operation.

The special feature of the present invention is that a support and a centering device (3, 4, 6) are fitted between the base 7 and the casting shoe 5 which makes it possible to center the casting shoe securely and in an accurate position in relation to the casting mold. In the example shown in the drawings the support includes air cushions 6 fitted between the casting shoe 5 and the base 7. The air cushions 6 can be located adequately in recesses 9 formed in the casting shoe 5 or the base 7 so that they are located completely in these recesses and so that the casting shoe rests directly (metal against metal) on the base when the air supply is shut off.

The centering device includes at least two (one at either end of the casting shoe) guide pins 3 protruding downwardly from the casting mold 2. The guide pins 3 are designed to correspond to guide sleeves or openings on the casting shoe 5. The positions of the pins 3 and the sleeves 4 may be reversed. Both the pins 3 and the sleeves 4 have conically shaped surfaces 13, 14 which guide the two parts into an interfitting position with each other. Each guide sleeve 4 is fitted in detachable and adjustable juts or brackets 8 so that they can be adjusted individually in advance in relation to the particular casting shoe to ensure that the casting shoe is in the correct position during the centering operation. Instead of pins and sleeves, another centering device may be used, if required, for example wedges with bevel edges pointing downwards from the casting mold which bear against the outside of the casting shoe 5. The casting shoe 5 is, moreover, fitted with a downwardly projecting edge 11 which prevents it from being displaced too far sideways in relation to the base 7, and thus ensures that the guide pins 3 are inserted into the sleeve 4.

Figure 2:
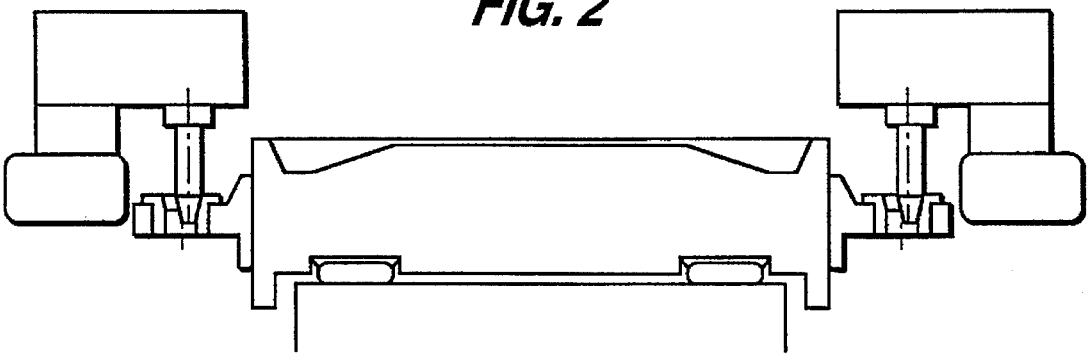

In connection with the process of centering the casting shoe 5 into the correct position before a casting operation, the base 7 is moved upwardly, and air or another gas is supplied (not shown in further detail) to the air cushions 6. The casting shoe 5 will consequently move upwardly and out of the friction interlock or engagement with the base, as shown in FIG. 2. The casting shoe can thus easily be moved sideways, and the impact on the guide pins 3 and the guide sleeves 4 will be minimal.

Figure 3:
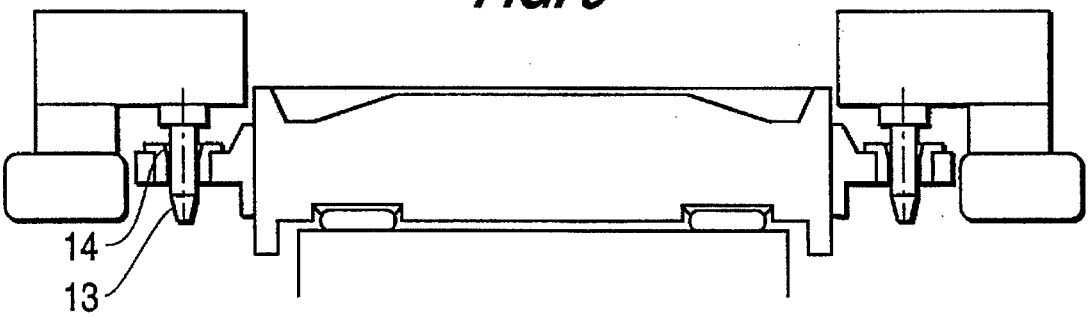
Figure 4:
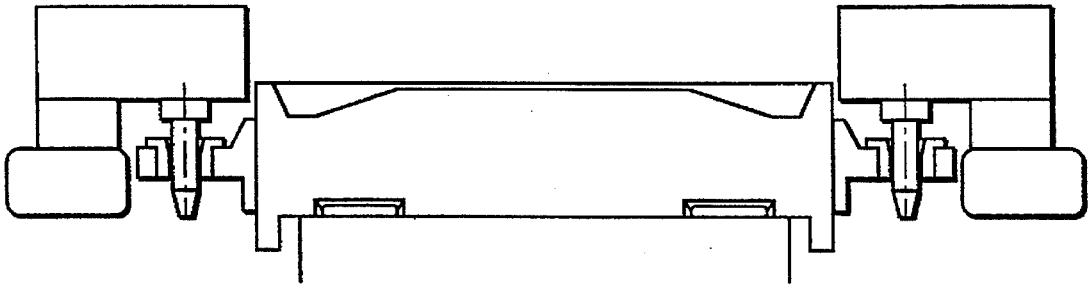

The centering operation can now be performed by raising the base 7 to an upper level at which the upper part of the casting shoe 5 is inside of and slightly protruding from the lower edge of the casting mold 2 as shown in FIG. 3. The air or gas supply is subsequently shut off so that the casting shoe 5 sinks down a few millimeters and again interlocks frictionally with the base 7 as shown in FIG. 4. It is important that the casting shoe 5 is not displaced in relation to the base 7 during the casting operation as such displacement would result in the casting workpiece being destroyed. Frictional locking, i.e. when the casting shoe rests directly on the base, will probably be sufficient for most casting molds to keep the casting shoe in place. As an extra measure, however, an extra locking device, such as a clamp device which presses the casting shoe against the base, can be provided.

The whole centering operation can be performed automatically by means of a logic control guide unit and electrical switching devices and components which are generally known, and therefore will not be mentioned further here.

In the example shown in the figures and described above, it has been indicated that the support between the casting shoe and the base includes two air cushions 6. It should be noted that the invention as defined in the claims is not limited to two cushions but can be used with one cushion or more than two cushions. Moreover, the invention is not limited to the use of cushions. Thus, for example, a ball support can be used which can be raised mechanically in order to lift the casting shoe from the base during the centering operation. Also, other types of support may possibly be used, but the necessary condition for this is that they result in so little friction that the casting shoe can easily be moved on the base.

We claim:

1. A direct chill casting apparatus comprising:

a casting mold having an inlet, an outlet, and defining a casting area between said inlet and said outlet;

a vertically moveable base movably mounted for vertical movement relative to said casting mold between a start position and a lowered position located below said start position;

a bottom block supported by said moveable base for movement with said moveable base between a first position in which said bottom block bears against said outlet and a second position below said first position; and a bottom block centering device including at least one air cushion positioned between said moveable base and said bottom block and being adjustable between an inflated state in which said at least one air cushion supports said bottom block above said moveable base and allows lateral movement of said bottom block relative to said moveable base, and a deflated state in which said bottom block rests on and frictionally engages said moveable base.

2. The direct chill casting apparatus as claimed in claim 1, wherein said at least one air cushion comprises two air cushions.

3. The direct chill casting apparatus as claimed in claim 1, wherein said centering device further comprises:

at least two tapered guide pins connected to said casting mold; and at least two sleeves connected to said bottom block, said at least two sleeves having conically shaped openings for guiding said at least two tapered guide pins into said at least two sleeves, respectively.

4. The direct chill casting apparatus as claimed in claim 3, further comprising two brackets mounted on said bottom block, wherein said at least two sleeves are supported on said bottom block by said at least two brackets, respectively.

5. The direct chill casting apparatus as claimed in claim 1, wherein said bottom block includes a lower surface which opposes an upper surface of said moveable base, and said bottom block has a projection which is positioned outwardly of said moveable base and extends downwardly below said upper surface of said moveable base.

6. A direct chill casting apparatus comprising:

a casting mold having an inlet, an outlet, and defining a casting area between said inlet and said outlet;

a vertically moveable base movably mounted for vertical movement below said casting mold outlet;

a bottom block supported on said moveable base and having a first surface opposing said outlet of said casting mold, and a second surface opposing said moveable base and located opposite said first surface, wherein said second surface has at least one recess defined therein; and a bottom block centering device for centering said bottom block relative to said casting mold, said centering device including at least one air cushion positioned in said at least one recess.

7. The direct chill casting apparatus as claimed in claim 6, wherein said at least one air cushion comprises two air cushions, and said at least one recess comprises two recesses.

8. The direct chill casting apparatus as claimed in claim 6, wherein said centering device further comprises:

at least two tapered guide pins connected to said casting mold; and at least two sleeves connected to said bottom block, said at least two sleeves having conically shaped openings for guiding said at least two tapered guide pins into said at least two sleeves, respectively.

9. The direct chill casting apparatus as claimed in claim 8, further comprising at least two brackets mounted on said bottom block, wherein said at least two sleeves are supported on said bottom block by said at least two brackets, respectively.

10. The direct chill casting apparatus as claimed in claim 6, wherein said bottom block includes a lower surface which opposes an upper surface of said moveable base, and said bottom block has a projection which is positioned outwardly of said moveable base and extends downwardly below said upper surface of said moveable base.

* * * * *